United States Patent [19]

Inagaki

[11] Patent Number: 4,509,540

[45] Date of Patent: Apr. 9, 1985

[54] COSMETIC PUFF

[76] Inventor: Masaaki Inagaki, 4-2-27 Sakashita-cho, Hatogaya-shi, Saitama-ken, Japan

[21] Appl. No.: 475,408

[22] Filed: Mar. 15, 1983

[30] Foreign Application Priority Data

May 24, 1982 [JP] Japan ..... 57-74993[U]

[51] Int. Cl.[3] ..... A45D 40/00

[52] U.S. Cl. ..... 132/79 R; 132/88.5

[58] Field of Search ..... 132/79, 88.5, 88.7, 132/9

[56] References Cited

U.S. PATENT DOCUMENTS 155,308 9/1849 Morrison ..... 132/9 UX 2,218,862 10/1940 Vredenburgh ..... 132/88.7

2,491,723 12/1949 Gelardin ..... 132/88.7 UX 3,759,375 9/1973 Nappi ..... 132/79 R 4,213,472 7/1980 Gueret ..... 132/88.7

*Primary Examiner*—Gregory E. McNeill

*Attorney, Agent, or Firm*—Birch, Stewart, Kolasch & Birch

[57] ABSTRACT

The present invention relates to an improvement in the cosmetic puff by which makeup powder is dusted on skin, and provides a cosmetic puff comprising a puff's main body of appropriately soft material connected to an end of a grip rod with interposition of a resilient connector member having a predetermined restoring force.

3 Claims, 1 Drawing Figure

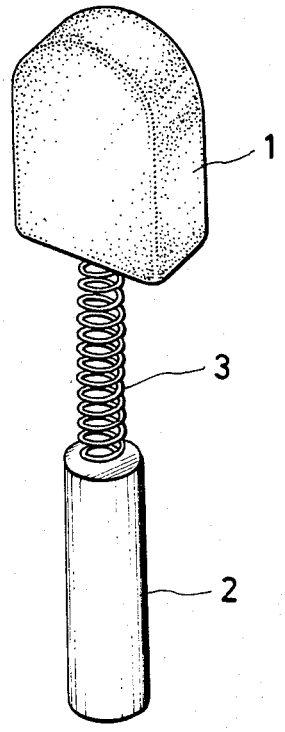
1
3
2

COSMETIC PUFF

BACKGROUND OF THE INVENTION

The present invention relates to a cosmetic puff.

The manner in which makeup powder is applied to the skin may be generally classified into three modes, i.e., the spreading mode, the brush-applying mode and the dusting mode.

The spreading mode is certainly advantageous in that all kinds of makeup powder other than cake powder can be effectively applied to the skin independently of the user's skill, but still has disadvantages that the coat formed by this spreading mode is too thin to cover imperfections in the skin and the makeup can not be maintained for a desired period.

With the brush-applying mode, liquid makeup can be evenly applied to the skin and, additionally, the tone which may be light or shade can be selectively controlled by adjusting the concentration of the liquid makeup. However, a high skill is required for this brush-applying mode and once the base layer (foundation) has been dried, it is impossible to put liquid makeup upon this base. This makes a retouch of makeup difficult.

The dusting mode is more advantageous in every aspect than both modes as have been mentioned above, because this mode permits a thickness of foundation to be selectively controlled by adjusting a force with which the dusting operation is done by the cosmetic puff; application upon foundation to be easily done; all kinds of makeup to be handled; and, most importantly, the finishing touches to be achieved with a uniform thickness without disturbing the foundation.

Nevertheless, said dusting mode has usually required a high skill and such high skill has been acquired only after training for a long time, so far as the cosmetic puff of prior art is used. It has been for this reason that the dusting mode has conventionally been employed only by a strictly limited number of experts although it has already been well known that the dusting mode has many advantages as previously mentioned.

SUMMARY OF THE INVENTION

A principal object of the present invention is to provide a cosmetic puff which is optimally suitable for applying makeup powder to the skin in the dusting mode having many more advantages than those of the spreading mode and of the brush-applying mode.

Another object of the present invention is to provide a cosmetic puff permitting makeup powder to be applied to the skin in the dusting mode without any requirement for high skill.

In accordance with the present invention, these objects are achieved by a cosmetic puff as defined by claim 1, i.e., a cosmetic puff comprising a puff's main body of appropriately soft material connected to an end of a grip rod with interposition of a resilient connector member having a predetermined restoring force.

Still further objects, features and advantages of the present invention will be apparent from the following description in reference with the accompanying drawing.

BRIEF DESCRIPTION OF THE DRAWING

The accompanying drawing is a perspective view showing a preferred embodiment of the present invention.

DESCRIPTION OF THE PREFERRED EMBODIMENTS

A preferred embodiment of the present invention will be described in reference with the accompanying drawing.

Referring to the drawing, a puff's main body 1 of appropriately soft and water-absorptive material, for example, sponge is provided. Although this main body 1 is shown in the drawing as having the shape as well as the dimensions similar to those of the puff's main body of prior art, it should be understood that the puff's main body may have its shape and dimensions other than those as shown. A grip rod 2 having a length in order of 4 to 6 cm and a diameter in order of 0.5 to 1.5 cm made of plastic or like material and a connector member 3 comprises a spring fixedly interposed between the puff's main body 1 and the grip rod 2.

The connector member 3 preferably has a restoring ability so preset that, when the puff is oscillated with the grip rod 2 held by hand, the puff's main body 1 is also oscillated with a certain delay with respect to the oscillation of said grip rod 2. Accordingly, it would be not preferable that this connector member 3 is too long or too short.

It should be noted here that said puff's main body 1, said grip rod 2 and said connector member 3 may be detachably connected together to provide a compact puff convenient as the portable implement.

In use of the cosmetic puff constructed as described above, a quantity of makeup powder, for example, foundation is placed on the puff's main body 1 previously immersed with moisture and then the puff is lightly oscillated or rotated with the grip rod 2 held by hand in various directions so that the puff's main body 1 may intermittently contact with skin. The quantity of makeup powder put on the puff's main body 1 is thereby dusted on skin with the same efficiency as achieved by the conventional dusting mode. Such efficiency is attributed to a fact that movement of the hand is indirectly transmitted by the connector member 3 comprising a spring or like to the puff's main body 1 with a certain delay. More specifically, the movement of hand is converted by the connector member 3 into a delicate variation of force and transmitted thereby to the puff's main body 1. Thus the present invention permits are facial makeup by the dusting mode which has conventionally been considered as the most preferable method to be easily realized without any requirement for a high skill.

It is obviously possible to adopt the cosmetic puff of the present invention not only for application of foundation but also for application of all the other types of makeup powder.

It is also obvious that there may be provided extensively various mode of execution without departure from the scope of the present invention. Accordingly, it should be understood that the present invention is not subjected to any limitation other than that as defined by the appended claims.

What is claimed is:

1. A cosmetic puff for applying makeup to the skin of an individual by utilizing a dusting mode of application comprising:

a main body of appropriately soft material for dusting an individual's skin with makeup;

a grip rod for grasping by an individual and including a first end and a second end; and spring means operatively connected to said main body and said first end of said grip rod, said spring means having a predetermined restoring force;

wherein said spring means transmits oscillating motion to said main body as said grip rod is actuated for dusting an individual's skin with makeup.

2. A cosmetic puff according to claim 1, wherein the spring is fixedly connected to the puff's main body and to the grip rod, respectively.

3. A cosmetic puff according to claim 1, wherein the spring means is detachably connected to the puff's main body and to the grip rod, respectively.

* * * * *